United States Patent [19]

Tschirky

[11] 4,133,397

[45] Jan. 9, 1979

[54] DRILLING WITH MULTIPLE IN-HOLE MOTORS

[75] Inventor: John E. Tschirky, Long Beach, Calif.

[73] Assignee: Smith International, Inc., Newport Beach, Calif.

[21] Appl. No.: 834,467

[22] Filed: Sep. 19, 1977

[51] Int. Cl.[2] ..... E21B 1/06

[52] U.S. Cl. ..... 175/96; 175/107; 175/325

[58] Field of Search ..... 175/95, 96, 102, 107, 175/325, 338, 94; 173/52; 299/59, 60, 62; 74/574

[56] References Cited

U.S. PATENT DOCUMENTS

| | | | |
|---|---|---|---|
| 2,016,068 | 10/1935 | Bannister | 175/96 |
| 2,829,864 | 4/1958 | Knapp | 175/325 |
| 2,942,850 | 6/1960 | Heath | 175/96 |
| 3,161,243 | 12/1964 | Davis | 175/95 |
| 3,386,521 | 6/1968 | Chadderdon et al. | 175/269 |
| 3,989,114 | 11/1976 | Tschirky et al. | 175/317 X |

FOREIGN PATENT DOCUMENTS

| | | | |
|---|---|---|---|
| 155368 | 2/1954 | Australia | 175/96 |
| 185815 | 11/1966 | U.S.S.R. | 175/96 |

*Primary Examiner*—Ernest R. Purser
*Assistant Examiner*—Richard E. Favreau
*Attorney, Agent, or Firm*—Philip Subkow; Bernard Kriegel; Newton H. Lee, Jr.

[57] ABSTRACT

A multiple in-hole motor and drill combination is disclosed for drilling a large diameter earth bore. The motor assembly is supported on a fluid circulating pipestring, and includes a plurality of circumferentially spaced longitudinally extended in-hole motor and drill combinations to which motor fluid is supplied through the running in pipestring, the motor fluid then passing through the rotary drill bit driven by the motor and returning to the top of the well. The plural in-hole motor drill assemblies are rotated during the drilling operation. A hydraulic drive motor powered by a separate fluid source is employed to rotate a housing to drive the multiple motor drill assemblies rotatably about the central support. The lower end of the multiple motor drill assembly supports a number of weights to apply drilling weight to the bits. The entire assembly is stabilized within the bore hole at vertically spaced locations or is stabilized within a well casing which is progressively lowered into the bore hole as the drilling progresses.

17 Claims, 5 Drawing Figures

DRILLING WITH MULTIPLE IN-HOLE MOTORS

BACKGROUND OF THE INVENTION

In the drilling of certain earth bore holes, both on shore and off shore, in the oil and gas well drilling industry, the practice is to initially drill a large surface bore hole in which a large surface pipe is to be set to form a section of surface casing. The large bore hole and casing may be on the order of 60" in diameter.

The drilling of such large bore holes requires the use of large drill bits and the application of large weight to the drill bits as they are being conventionally rotated to drill through the earth formation, during the circulation of drilling fluid, which is employed to also flush the cuttings from the bore hole.

SUMMARY OF THE INVENTION

The present invention provides a combined motor and drill assembly of the type wherein an in-hole fluid driven motor is employed to rotatably drive a drill bit, and a plurality of such in-hole motor and bit combinations are supported by a length of drill pipe or drill casing extending downwardly from the drilling rig, motor and drilling fluid being conducted through the pipestring from the drilling rig to drive the in-hole motors and to flush cuttings from the well bore as the drilling progresses.

Such large bore holes are not only employed in the drilling of wells, such as oil and gas wells, both on shore and off shore, but also large bore holes are frequently drilled in various mining and foundation forming operations. In all such large bore hole drilling operations the bit is rotated by a rotary drive, while drilling fluid is circulated to maintain the bits cool and to flush cuttings from the bit cutters and from the bore hole. Since the cutters are thrust forcefully against the end of the bore hole, during rotation of the fluid conducting string, the torque required to rotate the drill string is substantial.

In the case of the present invention, however, the in-hole motor and drill combinations are fluid actuated by the drilling fluid circulated downwardly through the drill pipe or drill casing, and each of the plurality of drills is required to drill only a portion of the bore hole, as the assembly is being progressively rotated, either by rotation of the running in drill pipe or casing or by the application of secondary motor fluid to a hydraulic drive motor which can effect revolution of the entire multiple in-hole motor and drill assembly.

The elongated assembly is stabilized adjacent to the lower end thereof above the rotary bits and adjacent the upper end at the rotary drive for the assembly by stabilizer units which are engageable with the sidewalls of the bore hole to maintain the assembly aligned with the hole as it progresses.

In accordance with one embodiment of the invention, the bore hole is progressively formed by the in-hole motor drill combination and the large casing is progressively lowered into the bore hole. Such a combined casing running and drilling operation is advantageous particularly in the case of the running of the large surface casing in offshore wells, wherein the casing is landed on a base on the ocean floor.

This invention possesses many other advantages, and has other objects which may be more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

DESCRIPTION OF THE PREFERRED EMBODIMENTS

Figure 1A:
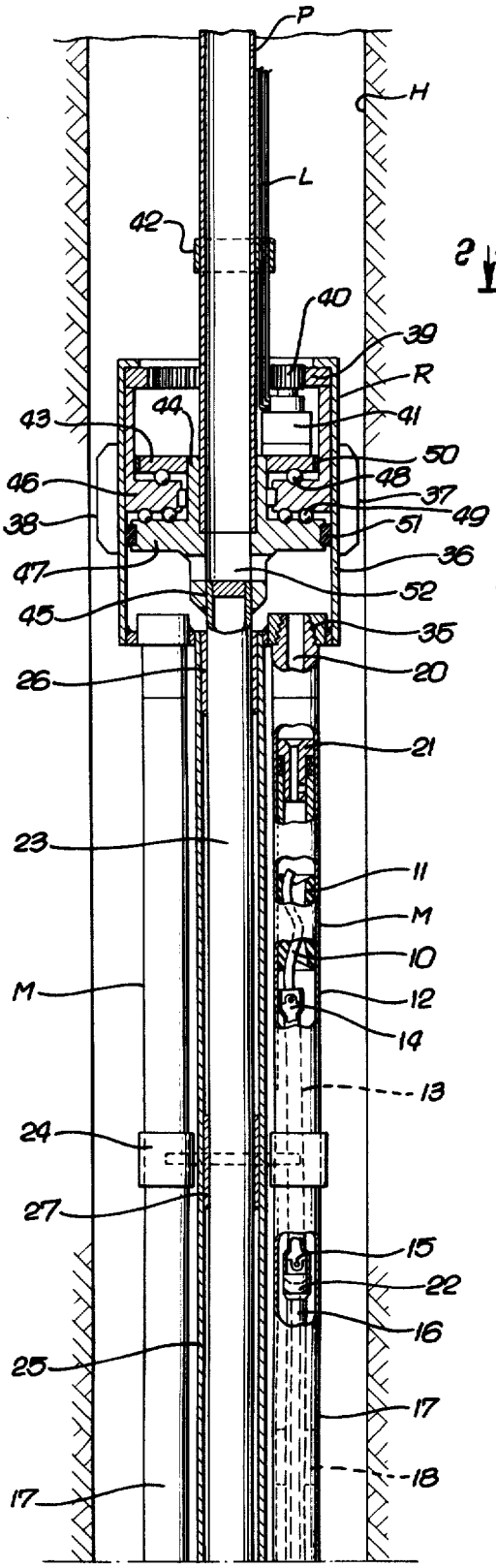
FIGS. 1*a* and 1*b* together constitute a view partly in vertical section and partly in elevation showing a multiple in-hole motor drill assembly made in accordance with the invention and disposed in a bore hole, FIG. 1*b* being a downward continuation of FIG. 1*a;*
Figure 1B:
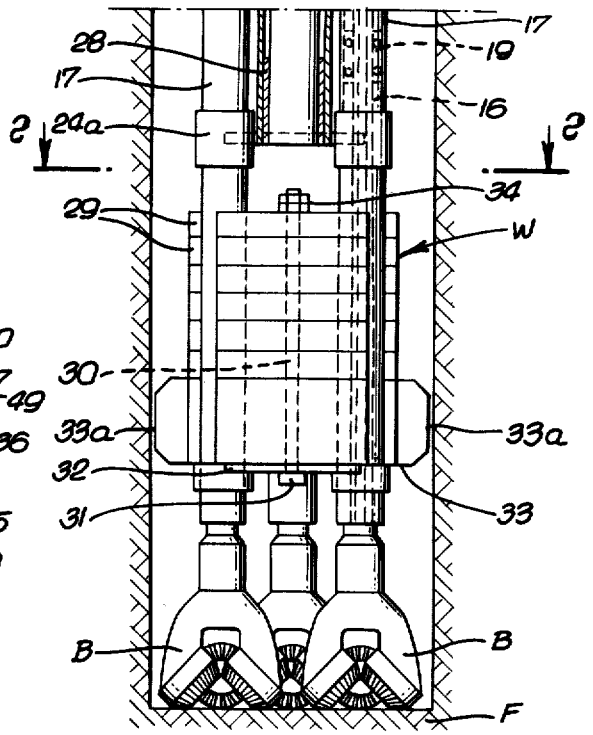

Referring to FIGS. 1*a* and 1*b* a bore hole H is shown as being drilled through an earth formation F by a plurality of rotatable roller bits B which are at the lower ends of a corresponding plurality of in hole motor assemblies M supported on a drill pipe or drill casing P which extends upwardly in the bore hole H to a drilling rig or platform (not shown), from which drilling fluid can be circulated downwardly through the drill pipe or casing P, exiting, as will be later described, through the respective bits B and then flowing upwardly through the bore hole H to the top of the hole, the fluid cooling the cutters of the bits and flushing cuttings from the bore hole.

Means are provided whereby the in-hole assembly can be rotated about its axis during the drilling operation. As is well known, the drill pipe or drill casing P, which is utilized in the drilling of bore holes, is typically rotated by a rotary drive table (not shown) during the drilling operation and the weight of the drilling string is applied to the cutters of the bits B to effect their penetration of the earth formation. Such a rotary drive may be applied to the drill pipe string P of the present disclosure, but the rotary motion is preferably applied by a subsurface rotary drive unit R powered by hydraulic fluid supplied through supply lines L suitably clamped to the pipe and extending to the upper end of the bore hole H for connection with a suitable pump source. The weight is applied to the bits B in accordance with the present invention by weight means W incorporated in the assembly above the bits B.

The motors M of the motor drill units, according to the present disclosure, are of the fluid driven helicoidal type, as for example more particularly disclosed in U.S. Pat. No. 3,989,114 granted Nov. 2, 1976 or U.S. Pat. No. 3,999,901 granted Dec. 28, 1976. Such motors include a rotor 10 revolvable in a stator 11 in response to the flow of motor fluid through the stationary housing of the stator, such fluid discharging from the stator into an elongated housing 12 in which is a connecting rod assembly 13, having an upper universal joint 14 connected to the motor rotor 10 and a lower universal joint 15 connected to a drive shaft 16 which extends downwardly through an elongated bearing housing 17. Within the bearing housing 17 are a suitable radial bearings 18 and thrust bearings 19, centralizing the drive shaft 16 within the bearing housing, and transmitting weight from the weight means W to the drive shaft 16, as it is being rotated by the motor means M. The connecting rod assembly 13 converts the eccentric or orbital motion of the lower end of the motor rotor 10 into concentric rotary motion of the drive shaft 16. The drilling fluid is adapted to be supplied to the motor and drill assembly through an upper inlet 20 at the upper end of the tubular housing assembly, passing downwardly through the usual valve 21, through the motor stator and into the connecting rod housing, from which it enters the hollow drive shaft 16 through upper port means 22 therein, the drilling fluid then passing downwardly through the drive shaft and exiting through the usual bit nozzles, as is well known in the case of drills of the type here involved.

In the illustrated form three of the motor and drill units are revolvably mounted about a central post or shaft 23 and are interconnected by upper and lower connecting collar and bracket assemblies 24 and 24*a* to an outer shaft or support 25, which is revolvable about the center shaft 23 on upper radial bearing means 26, intermediate radial bearing means 27 and lower radial bearing means 28, which are suitably mounted between the inner shaft of post 23 and the outer revolvable shaft 25.

Figure 2:
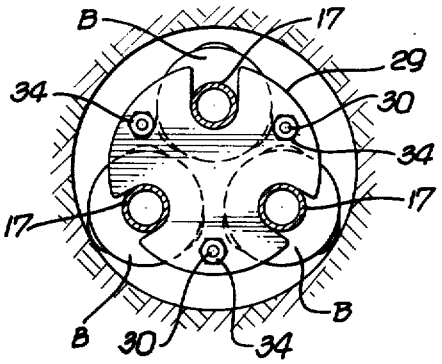
FIG. 2 is a transverse section as taken on the line 2–2 of FIG. 1*b.

In order to apply weight to the bits B to forcibly cause the cutters thereon to contact the earth formation, a suitable plurality of heavy plates 29 are provided, having as seen in FIG. 2, circumferentially spaced radially opening slots enabling assembly within the circumferentially spaced drive shaft or bearing housings 17, the weight plates 29 being clamped in place by clamping bolts 30 having lower heads 31 engaged beneath a plate 32 which is mounted between the bearing housings below a stabilizer unit 33, with suitable nuts 34 clamping the weight plates in place upon the plate 32. The stabilizer 33 is of a suitable construction, and as is well known, has either rollers or ribs 33*a* projecting outwardly therefrom in circumferentially spaced relation for centralizing the unit within the bore hole H during the drilling operation, while permitting the upward flow of drilling fluid between the drill assembly and the bore hole wall.

Adjacent the upper ends of the tubular motor drill assemblies, the housing structure is suitably connected or threaded into, at 35, the lower end of the rotary drive unit R. This drive unit R comprises an external cylindrical housing 36 which carries on its outer periphery a stabilizer 37, which like the stabilizer 33 has outwardly projecting ribs or rollers 38 for centralizing the drive unit housing 36 and therefore the upper end of the drill assembly within the bore hole H.

Within the housing 36 of the rotary drive unit R, adjacent its upper end, is suitably affixed an internal ring gear 39 which is meshed with a drive pinion 40 adapted to be rotated by a high torque, low speed hydraulic motor 41, to which motor fluid is supplied and exhausted by the previously referred to fluid lines L which are suitably clamped to the upwardly extended drill pipe or casing P as by suitable clamps 42. The motor 41 is mounted on an upper bearing plate 43 of a stationary inner sleeve 44, which is suitably affixed to the lower end of the pipestring P as well as to the upper end of the center shaft or post 23 of the drilling assembly, at 45. Suitably secured within the drive unit housing 36 is an outer bearing race member 46 which is disposed between the upper bearing plate 43 and a lower bearing plate 47 projecting outwardly from the bearing sleeve 44. Suitable upper and lower thrust bearings 48 and 49 are disposed between the bearing plates 43 and 46 between the bearing plates 46 and 47, whereby the housing 36 is supported on the bearings for rotation relative to the stationary drill pipe P and center post 25 of the assembly. Suitable upper and lower seals 50 and 51 are provided between the relatively rotatable components of the drive unit R so as to prevent the entry of drilling fluid into the region of the bearings.

It is apparent that drilling fluid passing downwardly through the drill pipe P can exit from the lower end of the latter through lateral passage means 52 provided in the stationary bearing member 44, the fluid passing into the lower end of the drive unit housing 36 and finding access to the upper passages 20 at the upper end of the respective housings of the motors M.

During use, as the drilling fluid supplied as just described through the drill pipe P enters the respective motors to drive the rotors 10 and consequently the respective drive shaft 16, the drill bits B are caused to rotate about their respective axes, the drilling fluid exiting through the bits and flowing upwardly in the bore hole H to the top thereof to flush cuttings therefrom. At the same time the entire assemblage is rotated, either by a rotary drive unit at the top of the well at the drilling rig, or by the rotary drive unit R described above. Since the individual bits B of the respective motor drill units are rotated by the fluid circulating downwardly through the pipestring P, the rotary drive effort necessary to rotate the cutting bits is substantially less than the effort necessary to drive a large bore hole bit.

As seen in FIG. 2, one of the motor-drill units is supported in an eccentric position, that is, so that its bit B is spaced inwardly from the wall of the bore hole and will cut away the core of the formation formed by the other bits as they form the sidewall of the hole.

Figure 3A:
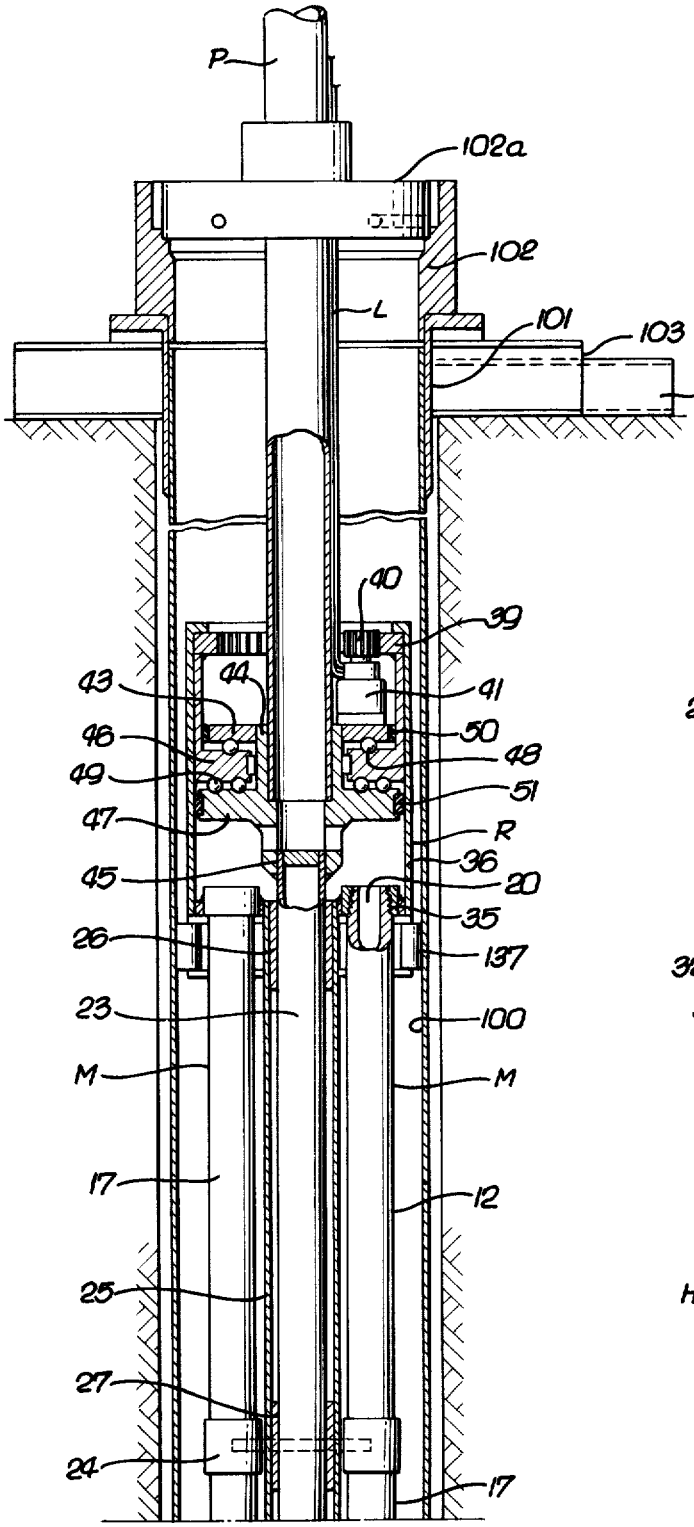
* and FIGS. 3*a* and 3*b* together constitute a view partly in vertical section and partly in elevation showing another multiple in-hole motor and drill assembly disposed in a well bore, into which casing is being simultaneously run along with the drilling operation, FIG. 3*b* being a downward continuation of FIG. 3*a*.
Figure 3B:
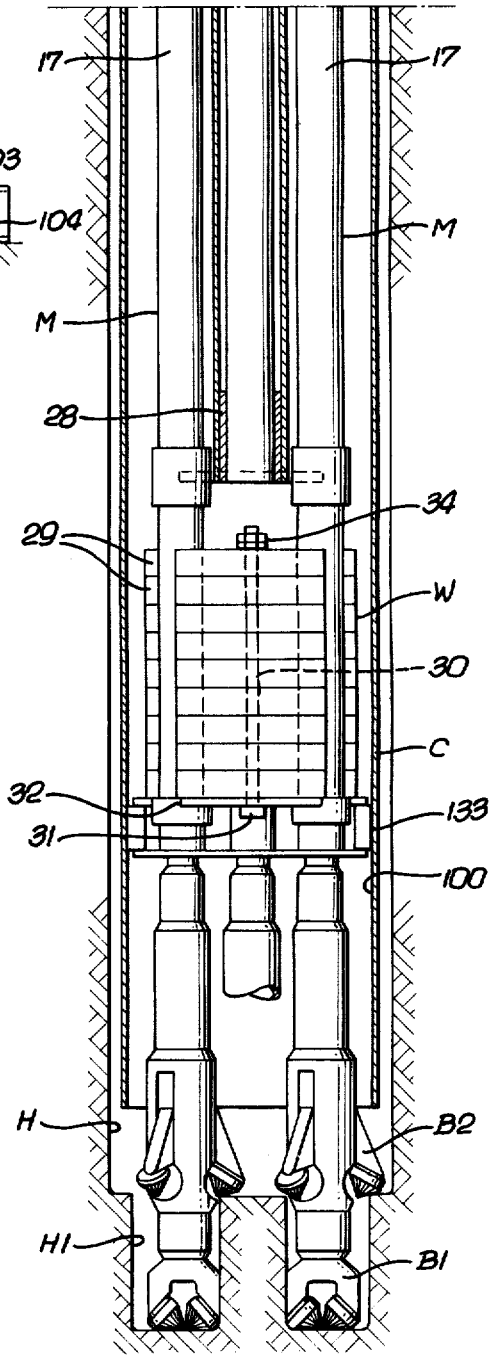

Referring to FIGS. 3*a* and 3*b*, a somewhat modified construction is illustrated wherein the bits B are of the type comprising a lower small diameter pilot bit B1 which initially drills a pilot hole H1, and expansible cutting arms B2 having their own small cutting elements thereon are expanded outwardly to enlarge the hole H and remove the central core defined by the respective pilot holes H1. Otherwise, the drilling assembly is the same as that illustrated in FIGS. 1*a* and 1*b*, including the weight means W, the respective motor units M and the rotary drive unit R, and accordingly similar reference characters are applied.

In this form, however, it will be noted that the lower stabilizing means include stabilizer elements 133 in the form of rollers, projecting outwardly from beneath the weight means, and the upper stabilizing means 137 includes rollers projecting outwardly from beneath the rotary drive unit R, the rollers of the respective stabilizing means being engageable with the inner side wall 100 of a length of bore hole casing C. In this connection, the lowering of the bore hole casing C into the bore hole H as the drilling progresses, is more particularly the subject of my companion application, Ser. No. 848,468, filed Mar. 28, 1978.

The casing C extends to the top of the bore hole H and is supported by casing hanger means 101 below a conductor pipe housing 102, run on a setting tool 102*a* and landed on a subsea base 103 which is seated on the ocean floor and provides a drilling fluid and cuttings discharge conduit 104. The tool 102*a* is releasable from the housing 102 in a known manner. The underreamer type bits B2 are expansible to enlarge the bore hole H to enable the progressive downward movement of the casing as the bore hole is being drilled, and cuttings and drilling fluid flow upwardly in the annular space between the casing and the bore hole wall. After completion of the drilling and casing operation, the tool 102a is released from the housing 102 and the pipestring and drilling apparatus pulled to the surface by the rig, the expansible cutters being retracted and passing through the casing. Thereafter, the casing can be cemented in place, as customary.

From the foregoing, it will now be apparent that the invention provides a novel compound drill assembly, wherein a plurality of bits arranged in circumferentially spaced relation are individually driven by respective fluid operated motors, while the entire drilling assembly is revolved to drill the large bore hole. The invention also provides a novel method of drilling large bore holes using multiple in-hole motors in circumferentially spaced relation, and forming the bore hole as the apparatus is revolved and the drilling progresses.

I claim:

1. In-hole drilling apparatus comprising: a fluid motor assembly having a central support; a plurality of drilling fluid driven motors disposed in circumferentially spaced relation about said support; means for mounting said motors on said support for rotation thereabout; means for connecting said support to a drilling fluid conduit and directing drilling fluid from said conduit to the respective motors; said motors each having a housing structure for conducting drilling fluid therethrough; and a rotary drive shaft having passage means for discharging drilling fluid from said motors; said drive shafts being connectable with a bit to supply said drilling fluid to said bit from said passage means; additional fluid driven motor means between said support and said means for mounting said motors for rotating the motors; and means for conducting additional motor fluid to said additional motor means.

2. In-hole drilling apparatus as defined in claim 1; said additional motor means having gear means drivingly connected with said motors including a drive pinion on said additional motor means and a ring gear engaged with said pinion and carried by said means for mounting said motors.

3. In-hole drilling apparatus as defined in claim 1; including stabilizer means for centering said motors in a bore hole and weight means supported by said motors, including a number of weight members, and means for releasably mounting said weight members on said motors, a bearing housing connected to said motors, bearing means rotatably supporting said bearing housing on said support, a driven gear on said bearing housing, a drive gear on said additional motor means for driving said driven gear.

4. In-hole drilling apparatus as defined in claim 1; a bearing housing connected to said motors, bearing means rotatably supporting said bearing housing on said support, a driven gear on said bearing housing, a drive gear on said additional motor means for driving said driven gear.

5. In-hole drilling apparatus as defined in claim 1; a bearing housing connected to said motors, bearing means rotatably supporting said bearing housing on said support, a driven gear on said bearing housing, a drive gear on said additional motor means for driving said driven gear, said means connecting said support to a fluid conduit having passage means opening into said bearing housing, said housings of each of said motors opening into said bearing housing for the flow of fluid into said motors from said bearing housing.

6. In-hole drilling apparatus as defined in claim 1; including a rotary drilling bit at the end of each drive shaft having openings communicating with said passage means.

7. In-hole drilling apparatus as defined in claim 1; including a rotary drill bit at the end of each drive shaft having openings communicating with said passage means, said drill bits having a pilot drill cutter and bore hole enlarging cutters.

8. In-hole drilling apparatus as defined in claim 1; one of said motors and its drive shaft being spaced radially with respect to another of said motors and its drive shaft to cause the bits of the respective motors to remove the core of the formation and form the side wall of the hole.

9. In-hole drilling apparatus as defined in claim 8, including a rotary drill bit on the respective drive shafts having openings communicating with said passage means.

10. In-hole drilling fluid driven motor drilling apparatus comprising: a plurality of elongated motor stators; means interconnecting said stators for revolution as a unit about the axis of a borehold including manifold means connectable to a string of drill pipe and to each stator for conducting drilling fluid to each stator, rotor means in each stator rotatable by the flow of drilling fluid through each stator; a drive shaft connected to each rotor and connectable with a bit, one of said drive shafts being spaced radially of the axis of revolution of the apparatus with respect to another of said drive shafts to cause bits driven by the respective drive shafts to remove the core and form the side wall during drilling of the borehold.

11. In-hole drilling apparatus as defined in claim 10; including rotary drive means connected to said stators to cause said revolution.

12. In-hole apparatus as defined in claim 10; stabilizer means spaced longitudinally of said stators for centralizing the apparatus in the bore hole.

13. In-hole drilling apparatus comprising: a fluid motor assembly having a central support; a plurality of drilling fluid driven motors disposed in circumferentially spaced relation about said support; means for mounting said motors on said support for rotation thereabout; means for connecting said support to a drilling fluid conduit and directing drilling fluid from said conduit to the respective motors; said motors each having a housing structure for conducting drilling fluid therethrough; and a rotary drive shaft having passage means for discharging drilling fluid from said motors; said drive shafts being connectable with a bit to supply said drilling fluid to said bit from said passage means; additional fluid driven motor means between said support and said means for mounting said motors for rotating the motors; and means for conducting clean motor fluid to said additional motor means; one of said motors and its drive shaft being spaced radially with respect to another of said motors and its drive shaft to cause the bits of the respective motors to remove the core of the formation and form the side wall of the hole.

14. In-hole drilling apparatus as defined in claim 13, including a rotary drill bit on the respective drive shafts.

15. In-hole drilling fluid driven motor drilling apparatus comprising: a plurality of elongated motor stators; means interconnecting said stators for revolution as a unit about the axis of a borehold including manifold means connectable to a string of drill pipe and to each stator for conducting drilling fluid to each stator; rotor means in each stator rotatable by the flow of drilling fluid through each stator; a drive shaft connected to each rotor and connectable with a bit, and including rotary drive means connected to said stators to cause said revolution, one of said drive shafts being spaced radially of the axis of revolution of the apparatus with respect to another of said drive shafts to cause bits driven by the respective drive shafts to remove the core and form the side wall during drilling of the borehold.

16. In-hole drilling fluid driven motor drilling apparatus comprising: an assembly of a plurality of elongated motor stators interconnected in parallel spaced relation; a support rotatably mounting said assembly for revolution as a unit, a drilling fluid conduit connected with said support, passages leading from said conduit to each of said stators, a rotor in each stator connectable with a bit, said motors being arranged with at least one stator located with the center of rotation of its rotor radially spaced from the axis of revolution of said assembly a distance less than the rotor of another of the stators, whereby a bit on the respective rotors form the side wall of a bore hole and remove the core.

17. In-hole fluid driven motor drilling apparatus as defined in claim 16; including additional and independent fluid driven motor means connected with said assembly to revolve the same.

* * * * *